United States Patent [19]

Bernard et al.

[11] Patent Number: 4,553,771

[45] Date of Patent: Nov. 19, 1985

[54] SKI BINDING FOR CROSS-COUNTRY SKIING

[75] Inventors: Jean Bernard; Jean J. A. Beyl, both of Nevers; Christian Campillo, Garchizy; Daniel le Faou, Varennes Vauzelles, all of France

[73] Assignee: Ste Look, Nievre, France

[21] Appl. No.: 493,265

[22] Filed: May 10, 1983

[30] Foreign Application Priority Data

May 21, 1982 [FR] France ..... 82 08885

[51] Int. Cl.[4] ..... A63C 9/00

[52] U.S. Cl. ..... 280/615

[58] Field of Search ..... 280/620, 615, 621, 626, 280/627, 628, 624, 635, 618

[56] References Cited

U.S. PATENT DOCUMENTS

| | | | |
|---|---|---|---|
| 3,080,174 | 3/1963 | Reuge | 280/621 |
| 3,731,945 | 5/1973 | Johnson | 280/627 |
| 3,845,964 | 11/1974 | Johnson | 280/618 |
| 4,411,445 | 10/1983 | Kreyenbuhl | 280/615 |

FOREIGN PATENT DOCUMENTS

| | | | |
|---|---|---|---|
| 0033957 | 8/1981 | Fed. Rep. of Germany | 280/615 |
| 2497674 | 7/1982 | France | 280/615 |

*Primary Examiner*—David M. Mitchell
*Assistant Examiner*—Everett G. Diederiks, Jr.
*Attorney, Agent, or Firm*—Young & Thompson

[57] ABSTRACT

A ski binding for cross-country skiing comprises a locking lever provided with a nose for locking the toe end of the ski shoe in position and also with an extracting appendage. During disengagement of the ski shoe from the binding, the extracting appendage exerts an upwardly directed thrust beneath the toe end of the ski shoe, thus facilitating the disengagement operation.

2 Claims, 6 Drawing Figures

SKI BINDING FOR CROSS-COUNTRY SKIING

This invention relates to a ski-shoe binding for cross-country skiing. The binding is intended to receive the front end of a ski shoe by downward engagement and to maintain the shoe in securely attached relation to the ski while permitting upward movements of the skier's heel.

In cross-country ski bindings of this type, provision is made for a locking lever acted upon by an elastic element which prevents withdrawal of the toe end of the ski shoe after it has been positioned within the binding.

In order to disengage his or her shoe from the binding or in other words from the ski, the skier produces a pivotal displacement of the locking lever in opposition to the elastic element, usually by exerting pressure with the tip of his or her ski stick in order to release the shoe, the shoe being then withdrawn from the binding by lifting the toe end. However, the operation just mentioned is often lengthy and inconvenient since the ski has a tendency to move upwards with the skier's foot, with the result that it usually proves necessary in practice to shake the foot and the ski several times before finally disengaging the shoe. Furthermore, it frequently happens that the zones of contact between shoe and binding freeze while skiing is in progress. This has the effect of causing the shoe to adhere strongly to the ski binding, thus making the shoe-disengagement operation even more laborious.

The invention proposes to overcome this disadvantage.

To this end, the locking lever of the ski binding in accordance with the present invention is provided with an extracting appendage adapted to exert an upwardly-directed thrust beneath the toe end of the ski shoe when the locking lever undergoes a pivotal displacement towards its shoe-releasing position in opposition to the elastic element.

Positive extraction of the ski shoe is thus achieved and shoe disengagement is particularly easy and rapid.

Other features of the invention will be more apparent to those skilled in the art upon consideration of the following description and accompanying drawings, wherein.

Figure 1:
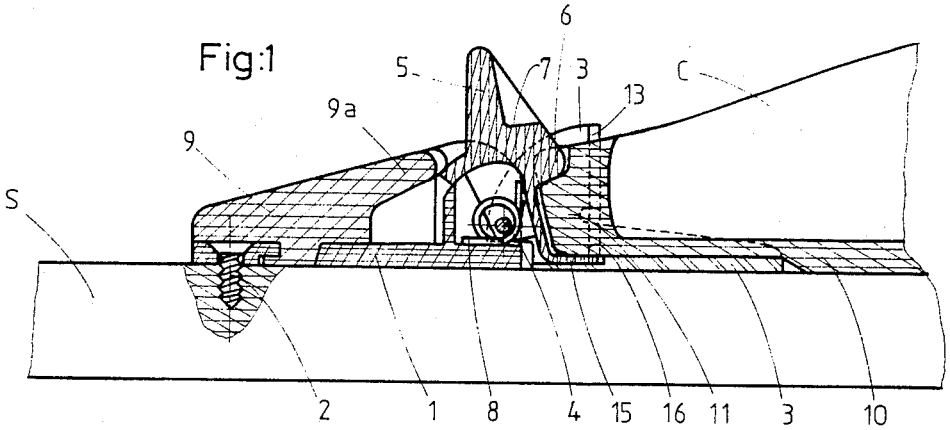
FIG. 1 is a side view of the first embodiment, taken in cross-section along the longitudinal vertical plane of symmetry of the ski, the ski shoe being shown in position in the ski binding.
Figure 2:
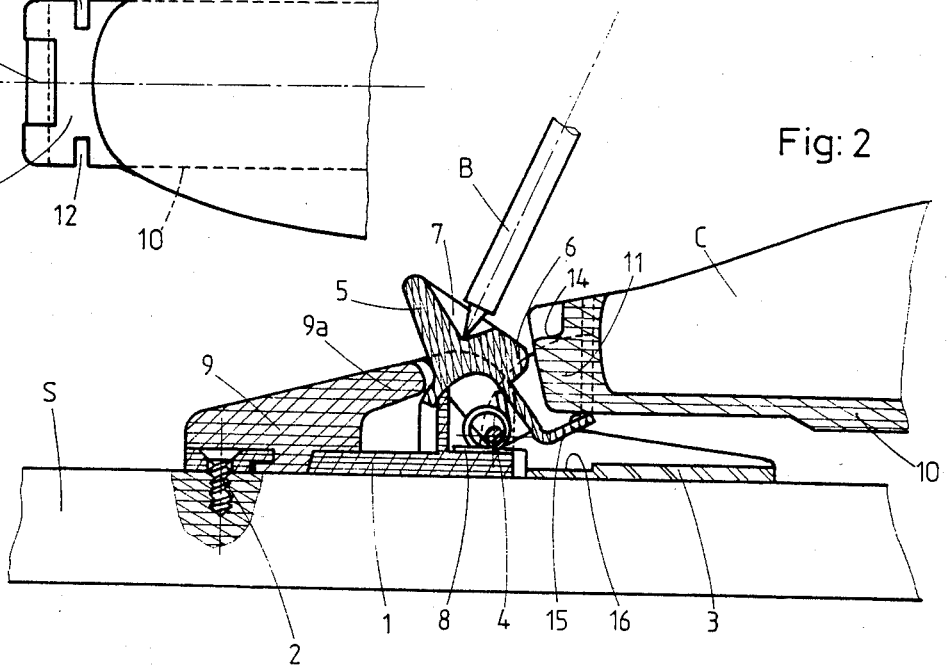
Figure 3:
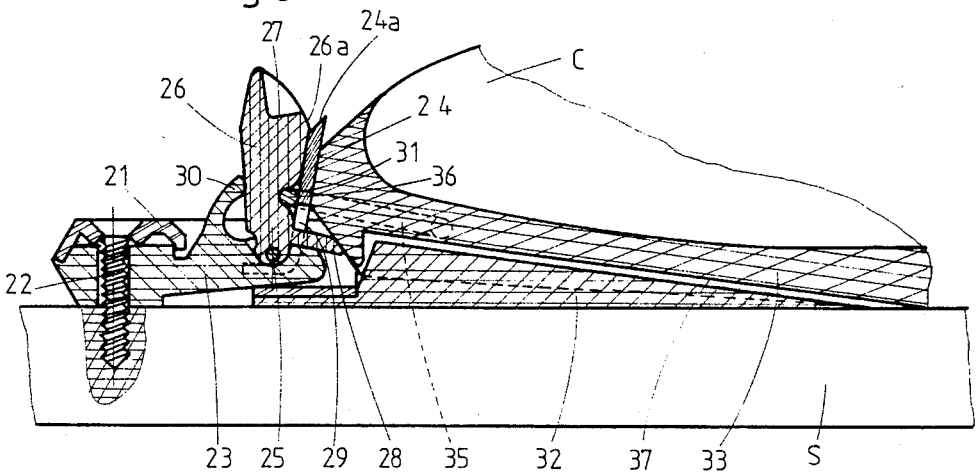
Figure 3A:
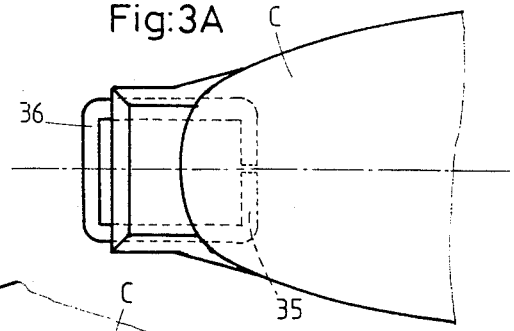
Figure 4:
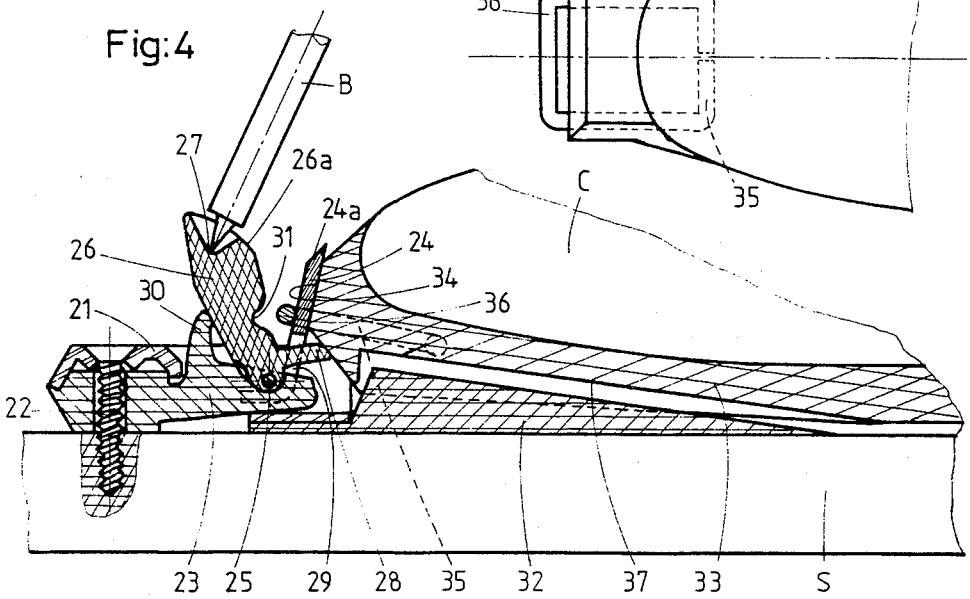

FIG. 2, which is similar to FIG. 1, shows a disengagement operation in which a ski shoe is being released from a binding by means of a ski stick;

FIG. 3 is a side view of the second embodiment, this view being taken in cross-section along the longitudinal vertical plane of symmetry of the ski, the ski shoe being shown in position within the ski binding ;

FIG. 3A is a top view of the, front portion or so-called toe block of the ski shoe of FIG. 3;

FIG. 4, which is similar to FIG. 3, shows a disengagement operation in which a ski shoe is being released from a binding by means of a ski stick.

Although not shown in the drawings, the pointed end of the ski is located to the left of the figures.

Figure 1A:
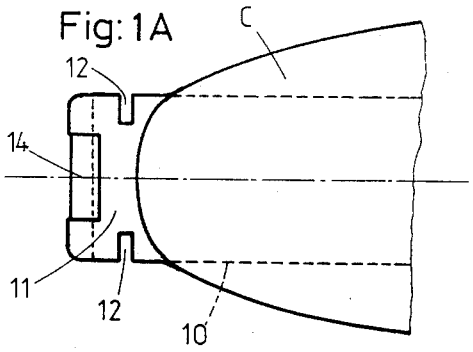
FIG. 1A is a top view of the toe end of the ski shoe.

The ski binding and the cross-country ski shoe of the first embodiment shown in FIGS. 1, 1A and 2 are of the same type as those disclosed in French patent application No. 82 03673 filed by the present Applicant.

Said ski binding comprises a base plate 1 fixed on a ski S by means of screws 2. On a horizontal cross-pin 4 carried by the plate 1 are pivotally mounted a shoe-retaining stirrup 3 as well as a locking lever 5. Said lever has a nose 6 for locking the ski shoe in position and is provided at its upper end with a recess 7 for receiving the tip of a ski stick. A torsion spring 8 which surrounds the cross-pin 4 is applied against the base 1 and acts on the lever 5 in order to maintain this latter in its active position, that is, a position which is close to the vertical.

An element 9 of synthetic rubber is embedded in the base plate 1 and has an upper portion **9*a* in the form of a tongue which is directed towards the front face of the lever 5**.

The toe end of the ski shoe C illustrated in FIG. 1A has a sole 10 and a front portion 11 or toe block which is of greater thickness than the sole and projects beyond the shoe upper. Said toe block 11 is provided with two vertical side grooves 12 which are capable of fitting within complementary vertical projections 13 carried by the shoe-retaining stirrup 3. A retaining recess 14 is formed in the top face of the toe block 11 and is intended to receive the locking nose 6.

In accordance with the invention, the lever 5 is provided with an extracting appendage 15 which, in the ski-shoe locking position, extends horizontally and is adapted to fit within a suitable flush-joint face 16 formed in the horizontal portion of the shoe-retaining stirrup 3. In this position, shown in FIG. 1, the ski shoe is maintained within the shoe-retaining stirrup 3 by virtue of the engagement of the projections 13 within the sole grooves 12 and the engagement of the locking nose 6 within the recess 14. The appendage 15 is placed beneath the toe block 11.

During the movements involved in cross-country skiing, lifting of the skier's heel causes the front portion of the sole or toe block together with the shoe-retaining stirrup 3 and the lever 5 to undergo a movement of pivotal displacement abcut the cross-pin 4 in the counter-clockwise direction as seen in the drawings while successively applying force to the torsion spring 8 and the elastic element 9.

In order to disengage each shoe from its ski binding, the skier produces a pivotal displacement of the lever 5 in that counter-clockwise direction by exerting pressure with the tip of the ski stick B within the lever recess 7 while maintaining his or her heel applied against the ski. Under these conditions, the shoe-retaining stirrup 3 remains stationary and the locking nose 6 moves away from the recess 14, thus releasing the toe block 11. During pivotal displacement of the lever 5, the appendage 15 moves upwards and exerts an upwardly-directed thrust beneath the toe block 11, thus tending to withdraw said toe block from the shoe-retaining stirrup 3 and considerably facilitating the shoe-disengagement operation (as shown in FIG. 2).

A point worthy of note is that it would be possible to dispense with the spring 8 by so arranging the elastic element 9 that this latter produces action directly against the lever 5 in order to bring this latter into the shoe-locking position.

The ski binding in accordance with the second embodiment and illustrated in FIGS. 3 and 4 comprises a casing 21 fixed on the ski S by means of screws 22. Within the casing 21 is housed a flexible strip 23 of synthetic elastic material. One of the screws 22 which serves to secure the casing passes through the front portion of the flexible strip 23 and also serves to attach said front portion to the ski. The rear portion of said strip 23 is adapted to carry a bearing member 24 which is added by overmolding. Said bearing member 24 has the shape of a small plate disposed transversely with respect to the ski and slightly inclined with respect to the vertical.

The flexible strip 23 is adapted to carry a cross-pin 25 on which is pivotally mounted an approximately vertical locking lever 26. Said lever 26 is provided at the lower end with an extracting appendage 28 which extends in the horizontal direction towards the rear end of the ski. Said appendage 28 passes through an opening 29 formed in the bearing member 24 in such a manner as to project behind this latter. The top portion of the lever 26 is hollowed-out so as to form a recess 27 for receiving the tip of a ski stick in order to permit shoe disengagement.

The top side of the flexible strip 23 is adapted to carry an elastic tongue 30 which is integral with said strip and exerts a thrust on the lever 26 so as to apply it against the bearing member 24. The rear face of the locking lever 26 (which is in contact with the bearing member 24) is hollowed-out so as to form a semicylindrical transverse notch 31.

The ski binding is also provided with a guide rib 32 of triangular cross-section, said guide rib being fixed on the ski S along the axis of this latter.

The front portion of the toe block of the sole 33 of the ski shoe C has a front bearing face 34 and is adapted to carry a fastening member 35 which is secured to the sole by overmolding. Said fastening member consists of a steel wire bent in the shape of a square ring, three sides of which are embedded in the sole whilst the fourth side 36 is disposed transversely in front of the face 34 at a distance equal to the thickness of the bearing plate 24.

A central groove 37 which is complementary to the rib 32 is cut in the underface of the sole 33.

In order to engage a shoe in the ski binding, the skier places his or her shoe in position above the binding so as to ensure that the fastening rod 36 comes into position between the beveled top ends 26*a*, 24*a* of the lever 26 and of the bearing plate 24 respectively. By applying a downward pressure with the toe, the fastening rod 36 moves downwards along the bearing plate 24 while forwardly displacing the lever 26 which compresses the elastic tongue 30. Once the fastening rod 36 has come into position opposite to the notch 31, the fastening rod 36 penetrates into the notch and is trapped within this latter whilst the lever 26 is again applied against the bearing plate 24 under the thrust exerted by the tongue 30. In this position and as shown in FIG. 3, the front face of the ski shoe 34 is applied against the bearing plate 24. The shoe is in a flat position on the ski and the rib 32 is engaged within the guide groove 37.

As a result of lifting of the heel during skiing, the toe end of the shoe, the bearing plate 24 and the lever 26 move together in the counterclockwise direction as shown in the drawings while causing deflection of the elastic strip 23. During this movement, the shoe is guided laterally on the ski by cooperation of the rib 32 with the groove 37.

In order to disengage a shoe from the ski binding, the skier displaces the lever 26 in that counterclockwise direction about the cross-pin 25 by exerting pressure with the pointed end of his or her ski stick B within the recess 27. During this pivotal displacement which causes compression of the tongue 30, the notch 31 disengages from the transverse fastening rod 36 which is consequently released. At the same time, the extracting appendage 28 exerts an upwardly directed thrust beneath the front end of the sole, thus facilitating disengagement of the fastening member 35 with respect to the bearing member 24.

It is readily apparent that the invention is not limited to the two examples of construction which have just been described and that various alternative forms may be contemplated.

Thus it follows that the extracting appendage carried by the locking lever does not necessarily form an integral part of said lever but could be added to this latter by riveting, for example.

Instead of a single central extracting appendage, it would be possible to provide two appendages each placed on one side. These appendages could apply force against the lateral edges of the front portion of the sole or, in the case of the second embodiment, could apply force against the ends of the fastening rod 36.

Finally it would be possible to provide suitable recesses or bosses beneath the front portion of the sole, thus improving the gripping action of the extracting appendage with respect to said front portion during a shoe-disengagement operation.

What is claimed is:

1. In a ski binding for cross-country skiing which comprises:

a shoe-retaining member which is secured to the ski and adapted to receive by downward engagement a toe end of the ski shoe;

a locking lever mounted on a cross-pin for pivotal displacement in a direction parallel to the ski and having locking means for maintaining the toe end of the ski shoe within the shoe-retaining member;

an elastic element for urging the locking lever pivotally toward the position in which it retains the toe end of the shoe;

the improvement comprising a rigid extracting appendage rigid with the locking lever and adapted to exert an upwardly directed thrust beneath the toe end of the ski shoe when the locking lever undergoes a pivotal displacement towards its shoe-releasing position in opposition to said elastic element, said elastic element comprising an elastic block fixedly secured to the ski forwardly of and bearing rearwardly directly againist the locking lever.

2. In a ski binding for cross-country skiing which comprises:

a shoe-retaining member which is secured to the ski and adapted to receive by downward engagement a toe end of the ski shoe;

a locking lever mounted on a cross-pin for pivotal displacement in a direction parallel to the ski and having locking means for maintaining the toe end of the ski shoe within the shoe-retaining member;

an elastic element for urging the locking lever pivotally toward the position in which it retains the toe end of the shoe;

the improvement comprising a rigid extracting appendage rigid with the locking lever and adapted to exert an upwardly directed thrust beneath the toe end of the ski shoe when the locking lever undergoes a pivotal displacement towards its shoe-releasing position in opposition to said elastic element, said elastic element comprising a coiled torsion spring acting between the ski and the locking device.

* * * * *